US007872428B1

(12) United States Patent
Papanicolaou

(10) Patent No.: US 7,872,428 B1
(45) Date of Patent: Jan. 18, 2011

(54) LINE OR LOW VOLTAGE AC DIMMER CIRCUITS WITH COMPENSATION FOR TEMPERATURE RELATED CHANGES

(76) Inventor: Elias S. Papanicolaou, 2317 Darnell Ct., San Jose, CA (US) 95133

( * ) Notice: Subject to any disclaimer, the term of this patent is extended or adjusted under 35 U.S.C. 154(b) by 315 days.

(21) Appl. No.: 12/008,677

(22) Filed: Jan. 14, 2008

(51) Int. Cl.
*G05F 1/00* (2006.01)

(52) U.S. Cl. ..... 315/291; 315/194; 323/239; 307/115

(58) Field of Classification Search ..... 315/158, 315/194, 195, 211, 291, 307; 323/268, 272, 323/239, 238, 324; 307/112–116; 361/42, 361/63, 86, 91; 219/212, 501
See application file for complete search history.

(56) References Cited

U.S. PATENT DOCUMENTS 4,300,090 A * 11/1981 Weber ..... 323/311
4,680,536 A 7/1987 Roszel et al.
4,689,547 A * 8/1987 Rowen et al. ..... 323/239
4,749,909 A * 6/1988 Smulders ..... 315/101
4,954,768 A 9/1990 Luchaco et al.
5,103,154 A * 4/1992 Dropps et al. ..... 318/782
5,327,047 A 7/1994 Gershen
5,537,010 A * 7/1996 Johnson et al. ..... 315/289
5,955,847 A * 9/1999 Rothenbuhler ..... 315/289
6,046,550 A * 4/2000 Ference et al. ..... 315/291
6,621,254 B1 9/2003 Williams
7,180,250 B1 2/2007 Gannon
7,193,404 B2 * 3/2007 Weightman ..... 323/325
7,241,979 B2 * 7/2007 Kil ..... 219/505

OTHER PUBLICATIONS

General Electric, "SCR Manual", 5th Edition 1972, pp. 91-92, 189-200, 231-240, 419-423.

* cited by examiner

*Primary Examiner*—Rajnikant B Patel

(57) ABSTRACT

TRIAC or SCR based dimmer circuits with temperature compensation features to enable them to also function properly with outdoor line or low voltage AC light fixtures. The TRIAC's or the SCR's operate as static switches that are ideal for driving directly resistive loads, such as incandescent lamps, in line or low voltage AC dimmer circuits. The performance of this type of a circuit is very temperature dependent but it can be compensated for temperature related changes in the output or load RMS voltage by means of preventing variations in the trigger angle the circuit is running at. Temperature compensation is achieved by means of zener diodes being incorporated in the trigger circuit section of a TRIAC or an SCR based dimmer circuit.

20 Claims, 5 Drawing Sheets

LINE OR LOW VOLTAGE AC DIMMER CIRCUITS WITH COMPENSATION FOR TEMPERATURE RELATED CHANGES

FIELD OF THE INVENTION

The present invention relates to AC phase control type dimmers utilizing TRIAC's or SCR's in applications that require the dimmer circuit to be compensated in order to prevent changes in the output or load RMS voltage as a result of environmental temperature variations.

WORD AND SYMBOL EXPLANATIONS

Whenever the following words or symbols are encountered in this document their true meaning would be as stated below.

Temperature: The temperature of the environment dimmer circuits according to the present invention would be used in. For example, this environment could be open air or the inside of a lamp or another light fixture or the engine compartment of an automobile and others.

Load: Electrical resistive load. Examples of resistive loads could be house or vehicle incandescent lamps, halogen or xenon lamps, heating elements and others.

Deg C: Degree or degrees Celsius.

BACKGROUND AND SUMMARY OF THE INVENTION

There is quite a number of the phase control type of dimmers in the prior art mainly for controlling the brightness of incandescent and fluorescent lamps. In the majority of these systems the TRIAC has been the device of choice mainly because of its simplicity to be easily configured with any load mostly in line voltage AC applications.

There are also TRIAC related dimmer circuits in the prior art for low voltage AC lighting systems mainly for dimming incandescent lamps. This type of dimming is often desired, for example, in landscaping to achieve the objectives of a particular architectural lighting scheme. Low AC voltages are usually obtained from standard step-down transformers or other low voltage sources such as alternators used in automobiles. An AC line voltage in the primary of a step down transformer can be reduced to 12 volts or 24 volts AC in the secondary. These low voltage sources can deliver high currents that are actually required, for example, in low voltage lighting to obtain high levels of lamp illumination.

A TRIAC based dimmer circuit, with the TRIAC requiring a high trigger voltage of about 35 volts, cannot be used to drive a load directly in a low voltage dimming system. In a number of these systems, in the prior art, the TRIAC is used to drive the primary side of a transformer. This can cause problems due to high voltage spikes and current surges that can be induced in a system when a fast switching device like a TRIAC is driving an inductive load such as the primary of a transformer. As a result of these problems the transformer would become hot and most likely it would be destroyed. The transformer is also at risk of being damaged from the DC voltage which is introduced in the primary because of the asymmetrical triggering of the TRIAC. Another problem with these dimming systems is that they can only drive one type of a transformer either a magnetic or an electronic and in most of these cases a third neutral wire would be needed. Still another problem is that lamps cannot be dimmed individually. Furthermore there are no claims for commercially available dimmers or in prior art that these systems can be used outdoors in conjunction with items such as landscape transformers or light fixtures.

TRIAC's and SCR's can also work in dimmer circuits as static switches. The drawback with these circuits is that they are very temperature dependent and if used outdoors the output voltage would change from where it is set initially. As a result of that the brightness of the lamp would also change. Another problem with these circuits would be the starting of the incandescent lamp becoming unreliable when operating with trigger angles close to 90 degrees. However this type of circuits, by also being able to function while connected in the low voltage side of a transformer or any other low voltage source, would constitute the prior art for the present invention. Changes in circuit performance, as a result of temperature variations, are compensated by means of zener diodes. This would insure that the performance of the circuit remains compensated as long as the circuit is operating at a suitable trigger angle within the trigger angle range for these circuits being from zero degrees to 90 degrees. In this mode of operation the life of the incandescent bulb is extended and a form of soft-start is introduced. Also the starting of the incandescent lamp load becomes very reliable even if operating with trigger angles close to 90 degrees. Furthermore in this type of circuits semiconductor AC devices, such as TRIAC's or SCR's, are driving incandescent lamp loads directly. Hence damaging voltage spikes or current surges do not exist. Also a residual DC voltage in the AC voltage output, due to the asymmetrical triggering of the TRIAC, would cause no problems but if correction is needed it can easily be achieved.

DETAILED DESCRIPTION OF THE PREFERRED EMBODIMENT

Figure 1:
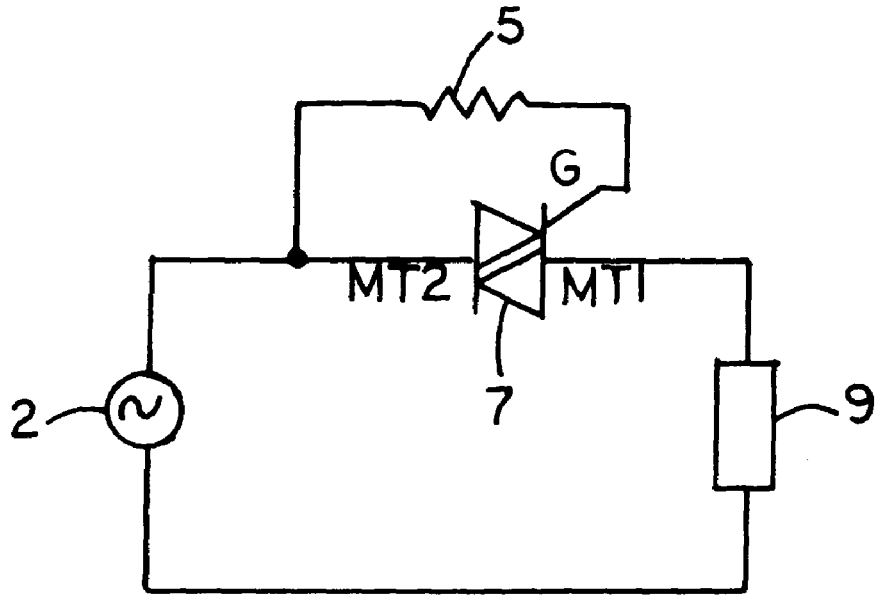
FIG. 1 PRIOR ART
FIG. 1 shows a prior art of a TRIAC based dimmer circuit for AC dimming applications.

FIG. 1 shows a prior art two-wire TRIAC based dimmer circuit for full-wave AC dimming applications. It comprises a TRIAC 7 and an incandescent lamp load 9 driven by an AC voltage source 2. The current limiting resistor 5 controls the trigger current into the gate G of TRIAC 7 during both the positive and negative half cycles of the AC voltage source 2. The temperature coefficient for these currents is about −0.5% per deg C. This implies that if the circuit is configured to operate at the top of the voltage waveform, for a positive temperature change of 100 deg C., the trigger angle can be decreased by as much as 60 degrees which would result in an increase of about 60% in the lamp load 9 brightness as a result of the output or load 9 RMS voltage being increased by about 30%. Also if the trigger angle, the circuit is running at, is high like at start up or close to 90 degrees the starting of the incandescent lamp load 9 becomes unreliable.

Figure 2:
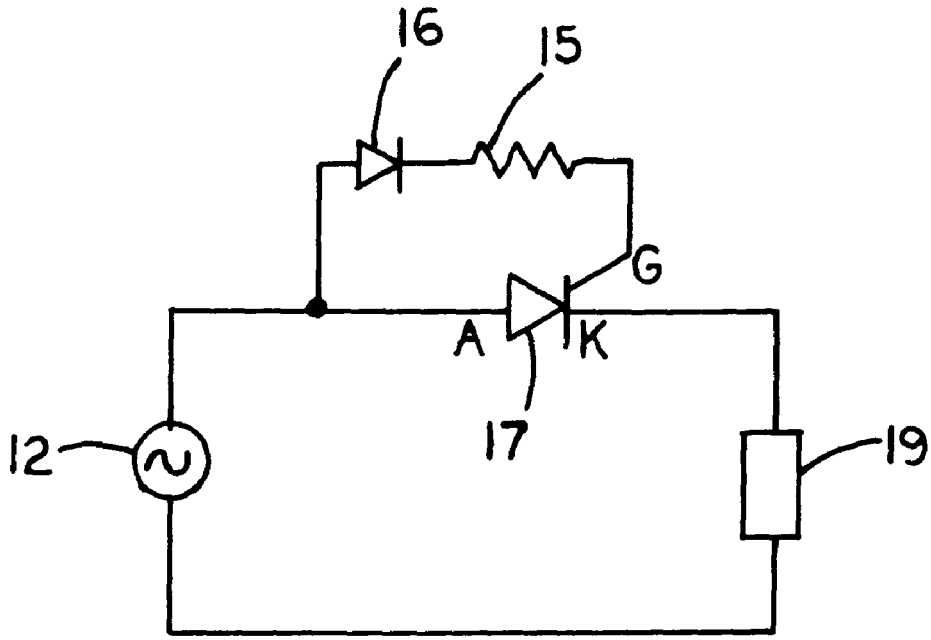
FIG. 2 PRIOR ART
FIG. 2 shows a prior art of an SCR based dimmer circuit for AC dimming applications.

FIG. 2 shows a prior art two-wire SCR based dimmer circuit for half-wave AC dimming applications. It comprises an SCR 17 and an incandescent lamp load 19 driven by an AC voltage source 12. The current limiting resistor 15 controls the trigger current into the gate G of SCR 17. The function of diode 16 is to pass trigger current into the gate G of SCR 17 only when the anode A of SCR 17 is positive with respect to cathode K of SCR 17. This implies that, if the circuit is properly connected between the AC voltage source 12 and the load 19, it can be made to work during either the positive or negative half cycle of the AC voltage source 12. The temperature coefficient of the trigger current in this circuit is also negative and the output AC or the load 19 voltage would be affected with temperature variations. Also the starting of the incandescent lamp load becomes unreliable if the trigger angle, the circuit is running at, is high or close to 90 degrees.

Figure 3:
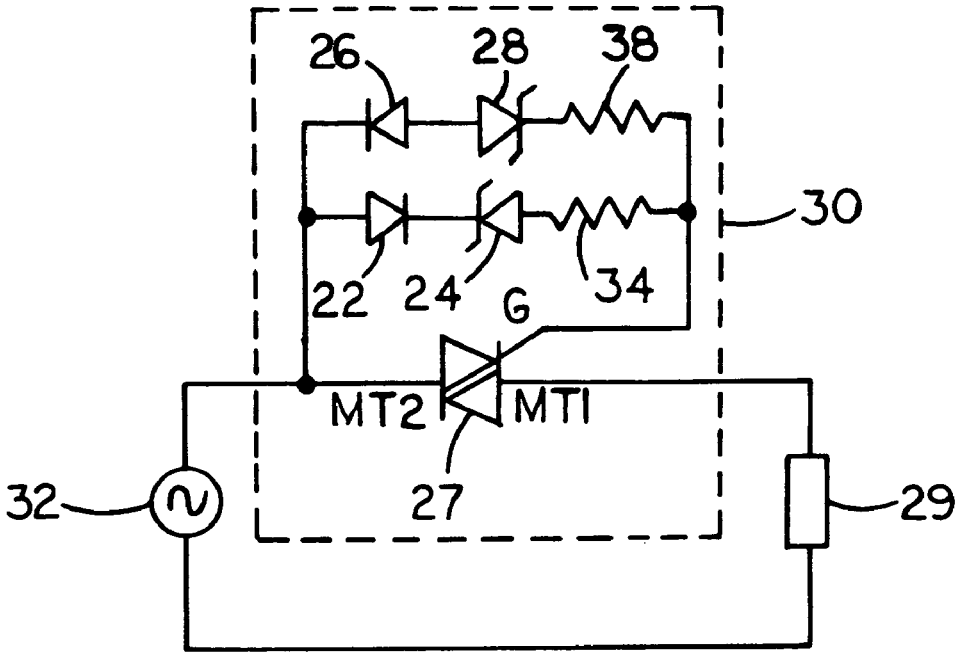
FIG. 3 shows a TRIAC based dimmer circuit for AC dimming applications according to one embodiment of the present invention.

FIG. 3 shows one embodiment of the present invention, a two-wire TRIAC based dimmer circuit 30 for line or low voltage AC full-wave dimming applications. Circuit 30 is in series connection with a lamp load 29 while AC voltage source 32 is coupled across circuit 30 and load 29. Circuit 30 comprises a TRIAC 27 having two circuit sections for triggering TRIAC 27. In one trigger circuit section the anode of diode 22 is coupled to the MT2 terminal of TRIAC 27 and cathode of diode 22 is coupled to the cathode of zener diode 24. One side of resistor 34 is coupled to the anode of zener diode 24 while the other side of resistor 34 is coupled to the gate G of TRIAC 27. In the other trigger circuit section the cathode of diode 26 is coupled to the MT2 terminal of TRIAC 27 and the anode of diode 26 is coupled to the anode of zener diode 28. One side of resistor 38 is coupled to the cathode of zener diode 28 while the other side of resistor 38 is coupled to the gate G of TRIAC 27. If the AC voltage source 32 is driving the MT2 side of TRIAC 27 then during the positive half cycle of the AC voltage source 32 diode 22 passes trigger current into the gate G of TRIAC 27 through zener diode 24 and current limiting resistor 34. Similarly during the negative half cycle of the AC voltage source 32 diode 26 passes trigger current into the gate G of TRIAC 27 through zener diode 28 and current limiting resistor 38. If the connection of circuit 30 is reversed and the AC voltage source 32 is driving the MT1 side of TRIAC 27 then during the positive half cycle of the AC voltage source 32 diode 26 passes trigger current into the gate G of TRIAC 27 through zener diode 28 and resistor 38. Similarly during the negative half cycle of the AC voltage source 32 diode 22 passes trigger current into the gate G of TRIAC 27 through zener diode 24 and resistor 34. When reverse biased, diodes 22 and 26 should conduct no current and this would be the case if they are rated to block at least the peak value of the AC voltage source 32. Diodes 22 and 26 can also be high voltage rectifiers or Schottky rectifiers.

The dimmer circuit of FIG. 3 provides compensation means for preventing changes in the output AC voltage as a result of temperature variations. This compensation is achieved by utilizing the positive temperature coefficient characteristic of zener diode voltages to offset predictable temperature related changes that would prevent the circuit from operating properly. More specifically the zener diode 24 voltage variation with temperature would offset the temperature related changes in the voltage drops across diode 22, resistor 34 and gate G to MT1 junction of TRIAC 27. Similarly the zener diode 28 voltage variation would offset the temperature related changes in the voltage drops across diode 26, resistor 38 and gate G to MT1 junction of TRIAC 27. The majority of these changes are due to the trigger currents having relatively high negative temperature coefficients. With this type of temperature compensation the trigger angle, the circuit is running at, is kept fixed and the output or load 29 AC voltage stable. Also with the zener diodes 24 and 28 in the circuit the voltage drops across resistors 34 and 38 are small and no longer the dominant factors for controlling the triggering of TRIAC 27. This function is being assumed by the zener diodes 24 and 28 and as a result of the voltage variations they provide with temperature there would be no problem with the starting of the incandescent lamp load 29 at any temperature even if the circuit is operating at trigger angles close to 90 degrees. Furthermore with resistors 34 and 38 by also being variable the voltage drops across them can be kept nearly constant with other TRIAC 27 devices having different trigger current values.

Figure 6:
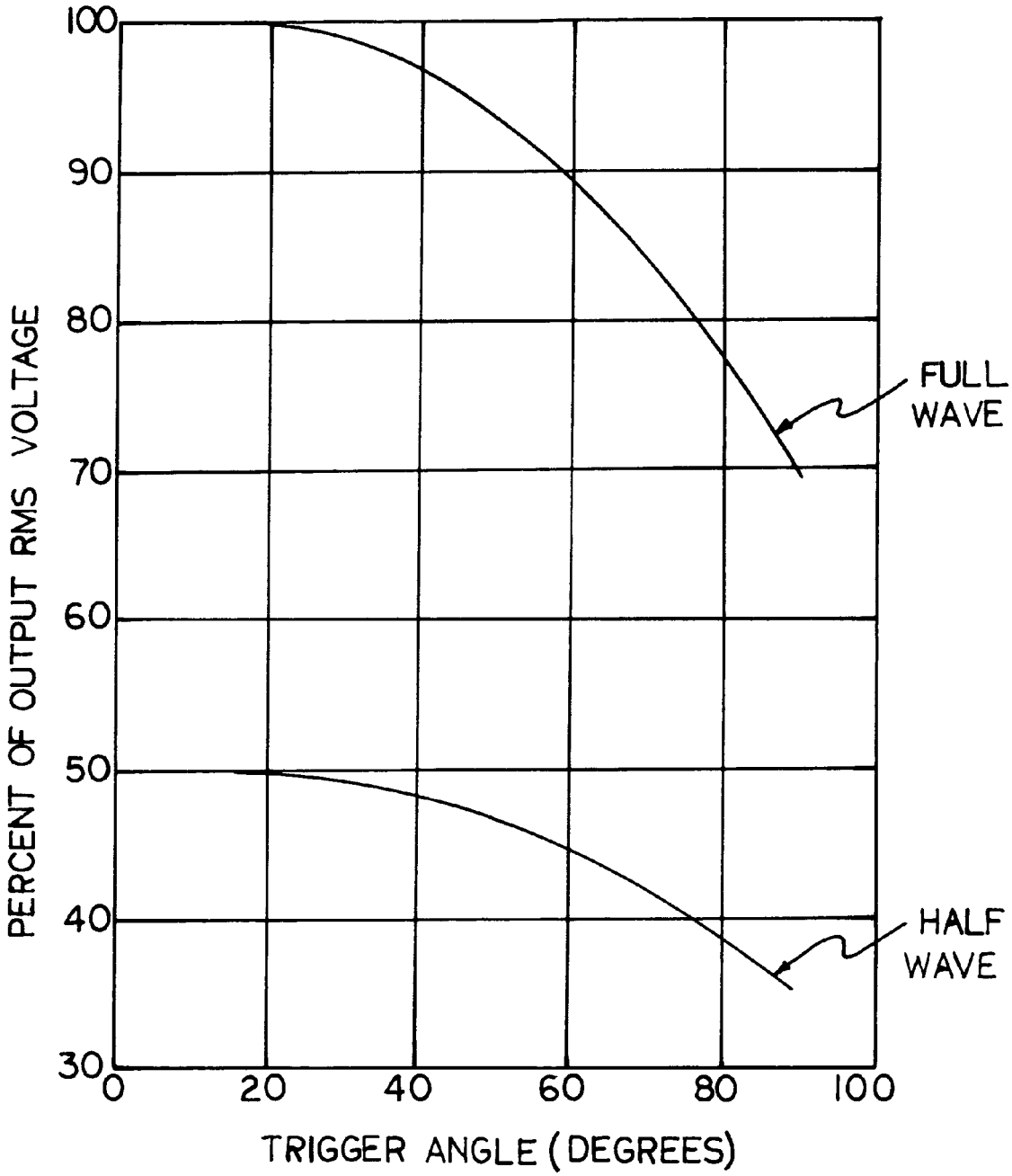
FIG. 6 shows a graph for load RMS voltage levels for various trigger angle values.
Figure 7:
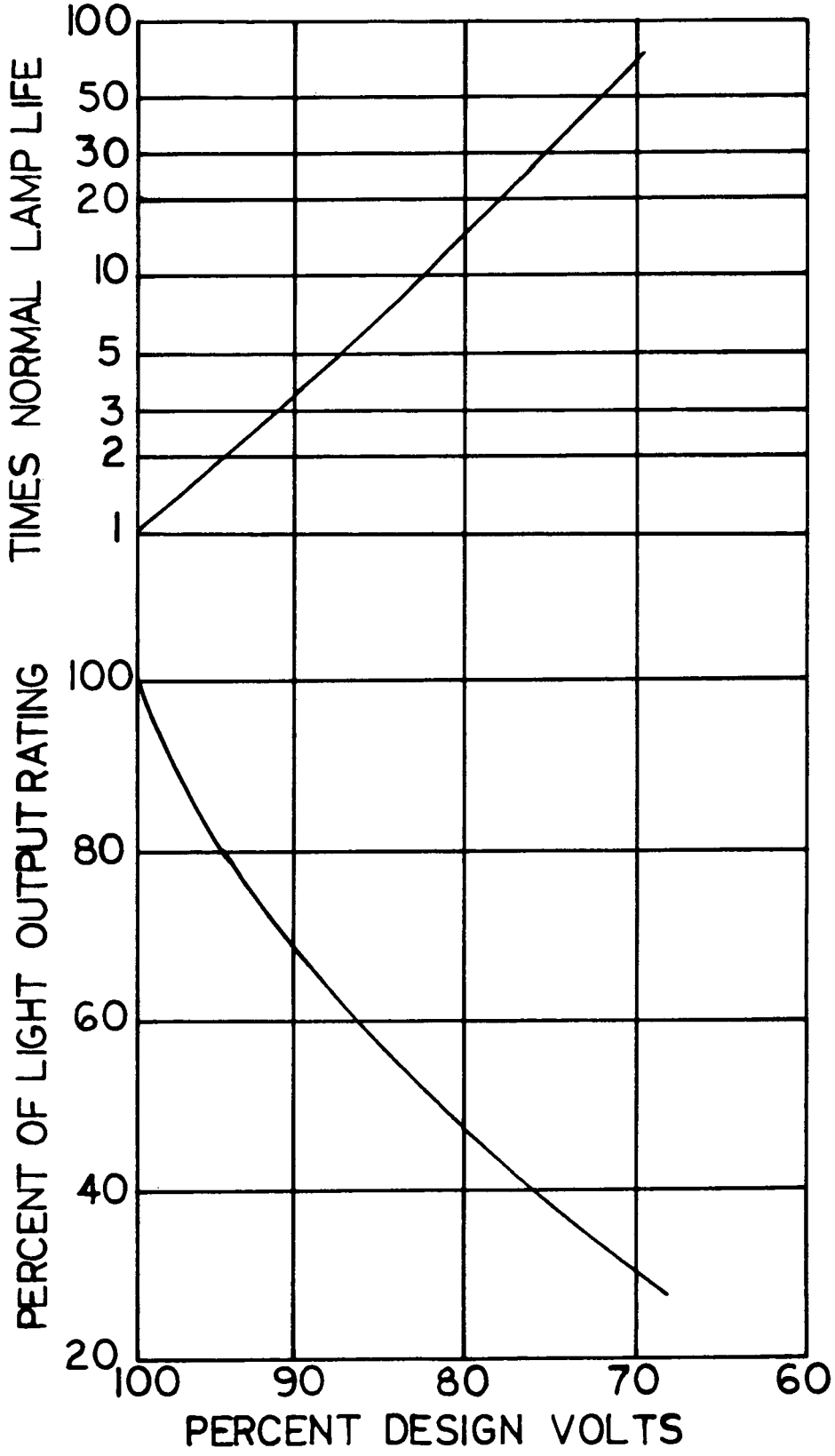
FIG. 7 shows graphs for light output and life expectancy of incandescent lamps.

In the dimmer circuit of FIG. 3, since the TRIAC 27 is driving directly an incandescent lamp load 29, there would be no problems with damaging voltage spikes or current surges that may not even be generated with load 29 being resistive. Furthermore any residual DC voltage in the load 29 AC waveform, as a result of the asymmetrical triggering of TRIAC 27, can be zeroed out by adjusting resistor 34 or 38. If no adjustment is needed the anode of zener diode 24 can be connected to the cathode of zener diode 28 and either resistor 34 or 38 can be omitted. For the performance of this dimmer circuit to be properly compensated for temperature variations the trigger angle, the circuit would be running at, should be in the range from zero degrees to 90 degrees. For example, if the dimmer circuit is adjusted to operate at a trigger angle of 67 degrees, the RMS output voltage would be at about 85% of line, the bulb life would be extended by at least 5 times the normal rating and the lamp brightness would drop to about 55% of rating. Other lamp brightness levels can be introduced by using trigger sections with different resistor 34 and 38 values and zener diodes 24 and 28 voltage values. Hence if by circuit means the various trigger sections are properly selected a dimmer system with several levels of lamp brightness can be constructed. Lamp brightness levels can only vary from 100% to about 30% due to the control range for this type of circuits being from 100% (trigger angle zero degrees) to about 70% (trigger angle 90 degrees). For small trigger angles the zener diode voltage method of compensation, for temperature related changes in circuit performance, may not be possible if zener diode voltages of less than 3.3 volts are to be utilized for this type of zener diodes would not be available. However as is the case with this type of circuit when running at small trigger angles compensation would not be needed in which case zener diodes 24 and 28 can be replaced with shorts. The reason for not needing compensation for small trigger angles is illustrated in the graph of FIG. 6 which shows the percent variation of the load RMS voltage as a function of the trigger angle in full-wave dimming applications. For example, if the circuit is running at a worst case trigger angle of 20 degrees and with a temperature coefficient of −0.5% per deg C for the trigger currents, then for a temperature change from −25 deg C. to 125 deg C. the trigger angle would change from about 25 degrees to about 10 degrees and the output or load 29 RMS voltage would change by about 1%. Actually if the circuit is running at a trigger angle close to zero degrees the full brightness of the lamp can be restored if a bulb of a higher wattage is used or if by circuit means the dimmer circuit is bypassed. When a lamp is not operating at 100% of line there would be energy saving as well as some form of soft-start for the lamp load 29. Depending on what percent of line an incandescent bulb is running at its light output and life expectancy can be read off the graphs shown in FIG. 7.

Figure 4:
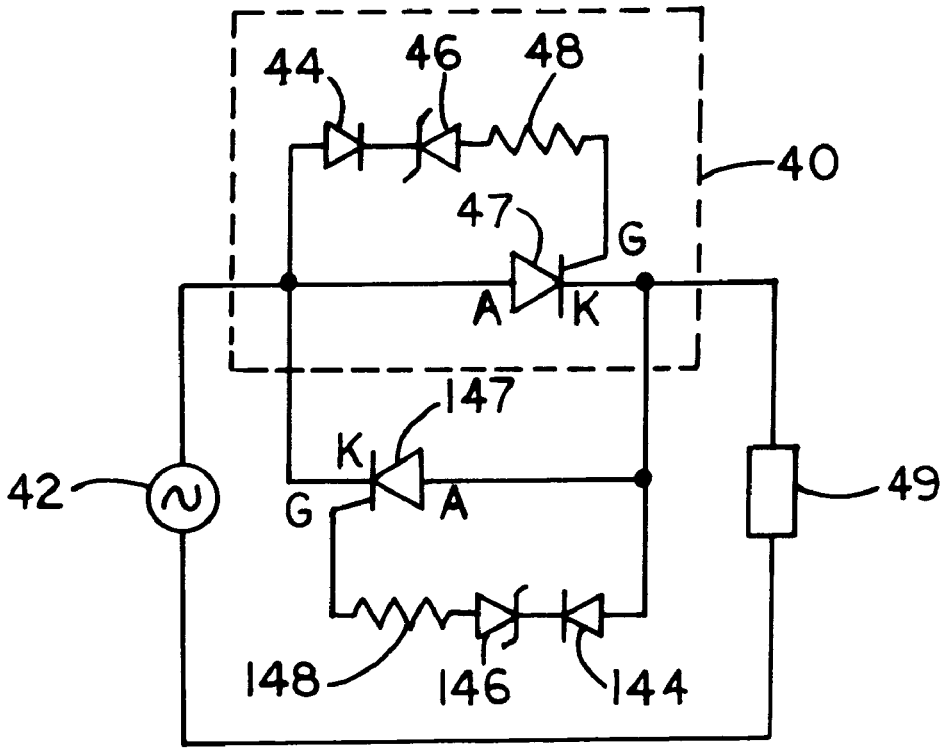
FIG. 4 shows an SCR based dimmer circuit for AC dimming applications according to a second embodiment of the present invention.

FIG. 4 shows another embodiment of the present invention, a two-wire SCR based dimmer circuit 40 for line or low voltage AC half-wave dimming applications. Circuit 40 is in series connection with an incandescent lamp load 49 while AC voltage source 42 is coupled across circuit 40 and load 49. Circuit 40 comprises an SCR 47 and a circuit section for triggering SCR 47. In the trigger circuit section the anode of diode 44 is coupled to the anode A of SCR 47. The cathode of zener diode 46 is coupled to the cathode of diode 44. One side or resistor 48 is coupled to the anode of zener diode 46 while the other side of resistor 48 is coupled to the gate G of SCR 47. If the voltage source 42 is driving the anode A of SCR 47 the circuit would conduct only during the positive half cycle of the voltage source 42. If the connection of circuit 40 is reversed and the voltage source 42 is driving the cathode K of SCR 47 the circuit would conduct only during the negative half cycle of the AC voltage source 42. When reverse biased, diode 44 should conduct no current if properly rated to block at least the peak value of the AC voltage source 42. Diode 44 can also be a high voltage rectifier or a Schottky rectifier. Compensation in this circuit is also achieved by means of the zener diode 46 the voltage variation of which can keep the trigger angle, the circuit is running at, fixed and the output AC voltage stable by offsetting the temperature related changes in the voltage drops across diode 44, resistor 48 and gate G to cathode K junction of SCR 47. If the circuit is running at small trigger angles compensation, for temperature related performance changes, would not be needed and zener diode 46 can be replaced with a short. The reason again for not needing compensation for small trigger angles is illustrated in the graph of FIG. 6 which shows the percent variation of the load RMS voltage as a function of the trigger angle in half-wave dimming applications. The circuit performance would not change if the gate G of SCR 47 is replaced with gate G of a TRIAC in which case the anode A and cathode K of SCR 47 are replaced with TRIAC terminals MT2 and MT1 respectively.

The dimmer circuit in FIG. 4 can be extended to a full-wave circuit if two circuits identical to circuit 40 are placed in inverse-parallel connection in which case load 49 would receive current from voltage source 42 during both the positive and negative half cycles of the AC voltage source 42. With this kind of arrangement the load 49 current is being shared by two SCR's and this most likely would introduce asymmetrical triggering which can be corrected by adjusting the resistor in one trigger circuit section. In general the performance of this circuit would be identical to the performance of the circuit in FIG. 3. However the full-wave circuit which comprises two SCR's is of more value than the circuit of FIG. 3 in applications where commercially available TRIAC's cannot handle excessive load currents. One such high load current application is in low voltage landscape lighting when several incandescent lamps must be driven from the same transformer. For example, in an average landscape lighting system where a 200 watt transformer with a 12 volt AC secondary is driving ten 20 watt lamps the total load current would be nearly 17 amps. A current of this magnitude may turn out to be too high for the circuit of FIG. 3 to be utilized.

Figure 5:
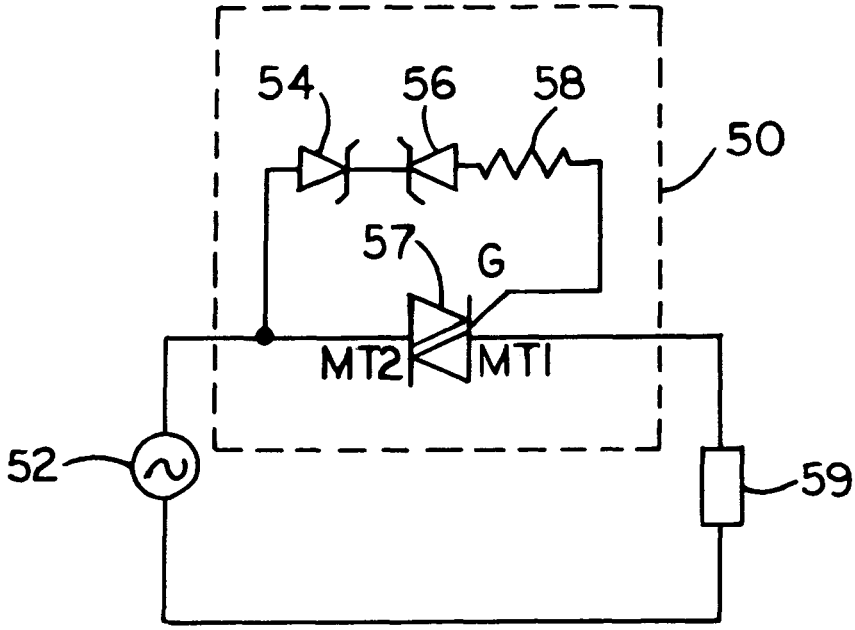
FIG. 5 shows a TRIAC based dimmer circuit for AC dimming applications according to a third embodiment of the present invention.

FIG. 5 shows still another embodiment of the present invention, a two-wire TRIAC based dimmer circuit 50 for line or low voltage AC full-wave dimming applications. Circuit 50 is in series connection with a lamp load 59 while AC voltage source 52 is coupled across circuit 50 and load 59. Circuit 50 comprises a TRIAC 57 and a circuit section for triggering TRIAC 57. The trigger circuit section comprises zener diodes 54 and 56 and resistor 58 connected in series and coupled across the MT2 and gate G terminals of TRIAC 57. Zener diodes 54 and 56 are depicted in a back-to-back connection. The performance of this circuit would be the same if either the cathodes or the anodes of zener diodes 54 and 56 are in a back-to-back connection. A bidirectional zener diode can also be used in place of both zener diodes 54 and 56. During each half cycle of the AC voltage source 52 one of zener diodes 54 and 56 is acting as forward biased diode while the other is functioning as zener diode. Hence the operation of this circuit is identical to the operation of the circuit in FIG. 3, except only for the fact that no adjustment can be made for the residual DC voltage in the AC output or load 59 voltage as a result of the asymmetrical triggering of TRIAC 57. This actually would not be a problem for load 59 by being resistive is capable of dissipating the effect of a small DC voltage superimposed on the AC load 59 voltage. Compensation in this circuit, for temperature related changes in performance, is achieved the same way as with the circuit of FIG. 3.

Experimental results indicate that for a dimmer circuit according to the present invention operating at a trigger angle of 67 degrees in a 12 volt RMS line and with proper zener diode voltage values of about 13 volts the variations in the trigger angle and output AC voltage is negligible even with positive temperature changes of up to 100 deg C. With a 120 volt RMS line and zener diode voltage values of about 130 volts the circuit performance at various ambient temperatures is similar to the performance with the 12 volt RMS line. It can therefore be concluded that a dimmer circuit, the embodiment of which is in accordance with the present invention, can function properly both indoors and outdoors as stand alone or integral part of a light fixture the body of which can also be configured to provide heat sinking for a TRIAC or an SCR.

One advantage of the dimmer circuits according to the present invention has to do with the fact that by introducing soft-start and extended bulb life not only lamps with long life span such as halogen or xenon but also inexpensive vehicle type low voltage lamps with not as long life span can be used as well. This could also extend the life of the automobile battery if several lamps, such as those used for day driving, could run off the alternator rather than the battery. Halogen lamps have been known to function properly when operated at voltages as low as 90% of line. However these lamps because of their sensitivity to weather elements and undesirable failure modes, are normally operated in fully enclosed fixtures. If these enclosures preserve heat, as they normally do, halogen lamps can work well even at lower voltages such as 80% or even 70% of line. Xenon lamps operate better at lower line voltages or with dimmer circuits.

Another advantage of the dimmer circuits according to the present invention is the cost. These circuits are very economical as well as easy to be included in new and existing fixtures such as those used in landscape lighting. Now days in a landscape lighting project dimming individual lamps may turn out to be very expensive if not impossible. For example if a group of lamps must run at a different brightness level, one solution would be to use another transformer, dimmer and cable. If other groups of lamps are to be treated the same way the cost of the project would be exorbitant with the kind of prices for power transformers low voltage dimmers and cables currently in the marketplace. Another solution would be to use a multi-tap transformer to run lamps at various voltages. This may not be very affordable either for the transformer most likely would not be a standard type and must be made specially with several taps and for outdoors use. There is also the cost of the additional runs of cable as well as the problems they may create in dropping the transformer voltage or even laying them out in sometimes difficult to get to places. A less expensive solution would be to use lamps of lower wattage for dimming purposes. One drawback in this case is that there would be no bulb life extension. Another problem could be that it might not be possible from a limited number of lower wattage lamp types to find a bulb which would produce the proper lighting effect. All these problems can be avoided and the cost saving would be enormous if circuits according to the present invention are utilized.

The invention claimed is:

1. A two-wire full-wave circuit for controlling the power received by a load and providing current limiting for the trigger current and compensation for temperature related changes in the output or load AC voltage comprising:

a TRIAC having terminal 1 and terminal 2 for connection in series with an AC voltage source and a load and gate terminal for triggering said TRIAC, first control circuit means comprising a first diode a first zener diode and a first resistor connected in series and coupled across said terminal 2 and said gate terminal, second control circuit means comprising a second diode a second zener diode and a second resistor connected in series and coupled across said terminal 2 and said gate terminal, when said terminal 2 is more positive than said terminal 1 said first diode being forward biased conducts current to trigger into conduction said TRIAC by rendering operative said first resistor for limiting the trigger current and said first zener diode voltage for providing compensation for temperature related changes in said load voltage;

when said terminal 2 is less positive than said terminal 1 said second diode being forward biased conducts current to trigger into conduction said TRIAC by rendering operative said second resistor for limiting the trigger current and said second zener diode voltage for providing compensation for temperature related changes in said load voltage.

2. The circuit of claim 1, wherein said first resistor is variable thereby enabling correction for asymmetrical triggering of said TRIAC.

3. The circuit of claim 1, wherein said second resistor is variable thereby enabling correction for asymmetrical triggering of said TRIAC.

4. The circuit of claim 1, wherein said load comprises one or more incandescent lamps.

5. The circuit of claim 1, comprising said first or said second control circuit means, thereby enabling half-wave circuit operation with said TRIAC conducting in alternate half cycles of said AC voltage source.

6. The circuit of claim 1, wherein said AC voltage source is the output voltage of a magnetic transformer.

7. The circuit of claim 1, wherein said AC voltage source is the 120V AC service voltage source.

8. The circuit of claim 1, wherein said load voltage compensation is due to temperature variations in the environment of said TRIAC and said first and said second control circuit means.

9. A two-wire half-wave circuit for controlling the power delivered to a load from an AC voltage source comprising:

an SCR having a gate and anode and cathode terminals for connection in series with an AC voltage source and a load, a control circuit comprising a diode a zener diode and a resistor in series, the series combination thereof being coupled across said anode terminal and said gate, in a first half cycle of said AC voltage source said diode being forward biased conducts current to trigger into conduction said SCR by rendering operative said resistor to limit the current to said gate and said zener diode breakdown voltage so as to establish a first trigger angle on said load voltage waveform and utilize the effect of said zener diode breakdown voltage temperature coefficient to prevent changes to said load voltage by providing proper compensation to said diode voltage, said resistor voltage and said gate trigger voltage for temperature related changes in the environment of said control circuit and said SCR.

10. The circuit of claim 9, wherein said resistor is selected to enable correction for said first trigger angle.

11. The circuit of claim 9, wherein said load comprises one or a plurality of incandescent lamps.

12. The circuit of claim 9, wherein said AC voltage source is a low AC voltage source.

13. The circuit of claim 9, wherein said AC voltage source is a high AC voltage source or the 120V AC service voltage source.

14. The circuit of claim 9, for extension to full-wave AC operation further comprising:

a second SCR having a second gate and second anode and second cathode terminals connected to said cathode and said anode terminals respectively to form an inverse-parallel connection with said SCR, including a second control circuit comprising a second diode a second zener diode and a second resistor in series, said series combination thereof being coupled across said second anode terminal and said second gate, in the half cycle of said AC voltage source adjacent to said first half cycle said second diode being forward biased conducts current to trigger into conduction said second SCR by rendering operative said second resistor to limit the current to said second gate and said second zener diode breakdown voltage so as to establish a second trigger angle on said load voltage waveform and utilize the effect of said second zener diode breakdown voltage temperature coefficient to prevent changes to said load voltage by providing proper compensation to said second diode voltage, said second resistor voltage and said second gate trigger voltage for temperature related changes in the environment of said second control circuit and said second SCR.

15. The circuit of claim 14, wherein said second resistor is selected to enable correction for said second trigger angle.

16. A two-wire full-wave circuit for controlling the power delivered to a load from an AC voltage source comprising:

a TRIAC having a gate and first and second main terminals for connection in series with an AC voltage source and a load, a control circuit comprising a first zener diode and a second zener diode in a back-to-back connection and a resistor in series, the series combination thereof being coupled across said first main terminal and said gate, in a first half cycle of said AC voltage source said first zener diode being forward biased contacts current to trigger into conduction said TRIAC by rendering operative said resistor to limit the current to said gate and said second zener diode breakdown voltage so as to establish a first trigger angle on said load voltage waveform and utilize the effect of said second zener diode breakdown voltage temperature coefficient to prevent changes to said load voltage by providing proper compensation to said first zener diode forward voltage, said resistor voltage and said gate trigger voltage for temperature related changes in the environment of said control circuit and said TRIAC;

in the half cycle of said AC voltage source adjacent to said first half cycle, said second zener diode being forward biased contacts current to trigger into conduction said TRIAC by rendering operative said resistor to limit the current to said gate and said first zener diode breakdown voltage so as to establish a second trigger angle on said load voltage waveform and utilize the effect of said first zener diode breakdown voltage temperature coefficient to prevent changes to said load voltage by providing proper compensation to said second zener diode forward voltage, said resistor voltage and said gate trigger voltage for temperature related changes in the environment of said control circuit and said TRIAC.

17. The circuit of claim 16, wherein said AC voltage source is a high AC voltage source or the 120V AC service voltage source.

18. The circuit of claim 16, wherein said resistor is selected to enable correction for said first or said second trigger angle.

19. The circuit of claim 16, wherein said load comprises one or a plurality of incandescent lamps.

20. The circuit of claim 16, wherein said AC voltage source is a low AC voltage source.

* * * * *